US007717756B1

(12) United States Patent
Yin et al.

(10) Patent No.: US 7,717,756 B1
(45) Date of Patent: May 18, 2010

(54) PROBE CONNECTOR

(75) Inventors: Te-Hung Yin, Taipei (TW); Yung-Yi Chen, Taipei (TW); Shu-Fang Li, Taipei (TW); Jui-Pin Lin, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/499,803

(22) Filed: Jul. 9, 2009

(51) Int. Cl.
*H01R 13/24* (2006.01)

(52) U.S. Cl. ..... 439/700

(58) Field of Classification Search ..... 439/700, 439/824
See application file for complete search history.

(56) References Cited

U.S. PATENT DOCUMENTS 6,340,320 B1 * 1/2002 Ogawa ..... 439/824
7,021,976 B2 * 4/2006 Sekiguchi ..... 439/824
7,201,613 B2 * 4/2007 Sasaki ..... 439/700
7,435,109 B1 * 10/2008 Sugiura ..... 439/83
2004/0266272 A1 * 12/2004 Maruyama et al. ..... 439/700
2006/0172613 A1 * 8/2006 Sasaki ..... 439/824
2009/0093171 A1 * 4/2009 Ju ..... 439/824

* cited by examiner

*Primary Examiner*—Gray F. Paumen

(57) ABSTRACT

A probe connector has a barrel having a main body which defines a chamber therein, and a base connected with one end of the main body. The main body has an opening at a middle portion thereof. A plunger is mounted to the barrel and partly exposes from the other end of the main body. A wrapping element surrounds an outer periphery of the main body. A resting element has a resting portion of arc shape, and two fixing slices extended opposite to each other from two ends of the resting portion. The resting portion projects into the chamber of the barrel through the opening. The fixing slices are sandwiched between the barrel and the wrapping element. The resting portion rests against a side of the plunger when the plunger is pressed downwards to deflect to contact an inner surface of the main body by an opposite side thereof.

8 Claims, 5 Drawing Sheets

PROBE CONNECTOR

BACKGROUND OF THE INVENTION

1. Field of the Invention

The present invention relates to a probe connector, and particularly to a probe connector having a structure capable of improving the connection stability between a barrel and a plunger thereof.

2. The Related Art

A probe connector mainly used in an electronic device generally includes a cylindraceous barrel, an elastic element assembled inside the barrel, and a plunger mounted to the barrel and partly projecting outside the barrel for contacting an outer electronic component. The plunger is pressed downwards by the electronic component to deflect to contact the barrel for achieving electrical connection. In order to improve the connection stability of the barrel and the plunger, conventionally, the plunger is formed with a ramped bottom surface which rests against an end of the elastic element. The ramped bottom surface of the plunger makes the elastic element compress and distort, in turn, the elastic element is provided with an opposite force which acts on the ramped bottom surface and slants the plunger to touch the barrel. However, such electrical connection between the barrel and the plunger is unstable and apt to break off instantly and discontinuously when the probe connector suffers from an unexpected force.

SUMMARY OF THE INVENTION

Accordingly, an object of the present invention is to provide a probe connector having a structure capable of improving connection stability between a barrel and a plunger thereof. The barrel includes a cylindraceous main body which defines a chamber therein, and a base connected with one end of the main body. The main body has an opening at a substantially middle portion thereof. The plunger includes a basic portion restricted in the barrel, and a contact portion extended from one end of the basic portion and exposed from the other end of the main body. A wrapping element surrounds an outer periphery of the main body. A resting element has a resting portion of arc shape, and two fixing slices extended opposite to each other from two ends of the resting portion. The resting portion projects into the chamber of the barrel through the opening. The fixing slices are sandwiched between the barrel and the wrapping element. The resting portion rests against a side of the basic portion when the contact portion is pressed downwards to deflect to contact an inner surface of the main body by an opposite side thereof.

As described above, the fixing slices of the resting element are sandwiched between the barrel and the wrapping element for fixing the resting element. The resting portion projects into the chamber through the opening. When the plunger is pressed downwards to make the basic portion extrude the resting portion outwards, in turn, the resting portion provides the opposite force pushing the basic portion to contact the inner surface of the main body securely, preventing the basic portion from breaking off the main body instantly and discontinuously when the probe connector suffers from the unexpected force.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENTS

Figure 1:
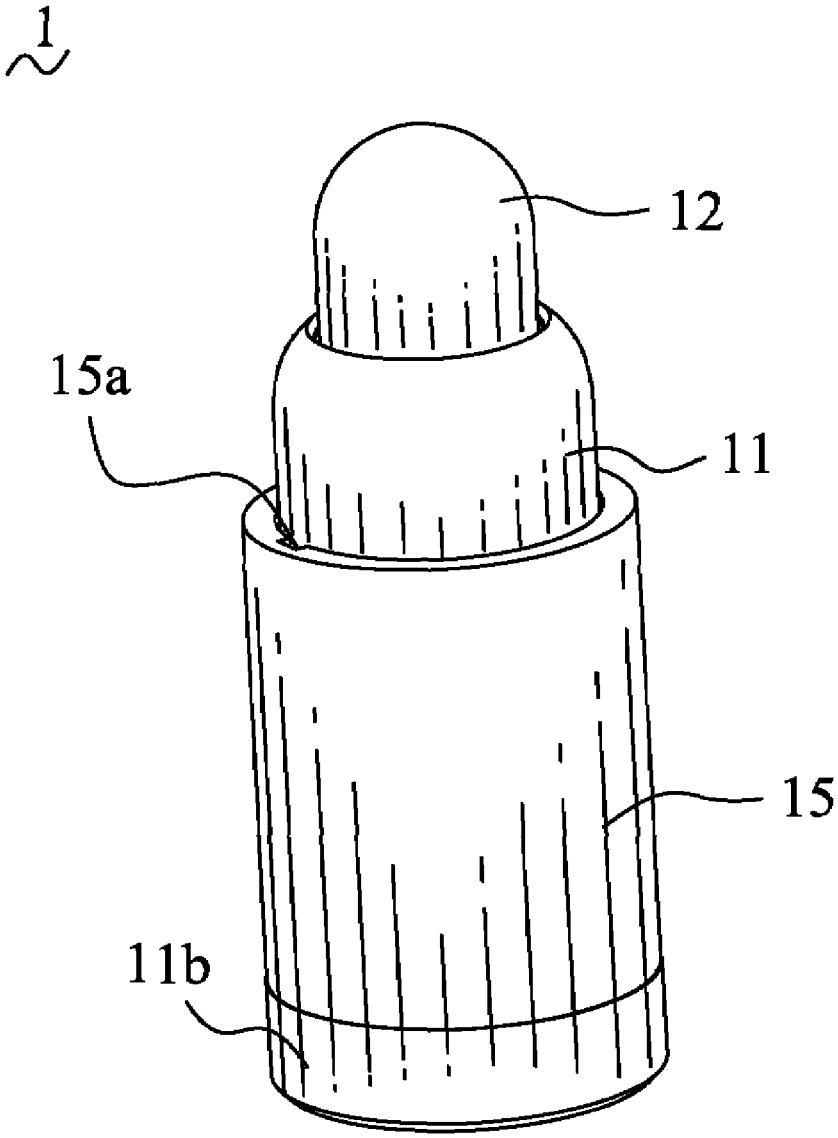
FIG. 1 is an assembled, perspective view of a probe connector of a first embodiment in accordance with the present invention.
Figure 2:
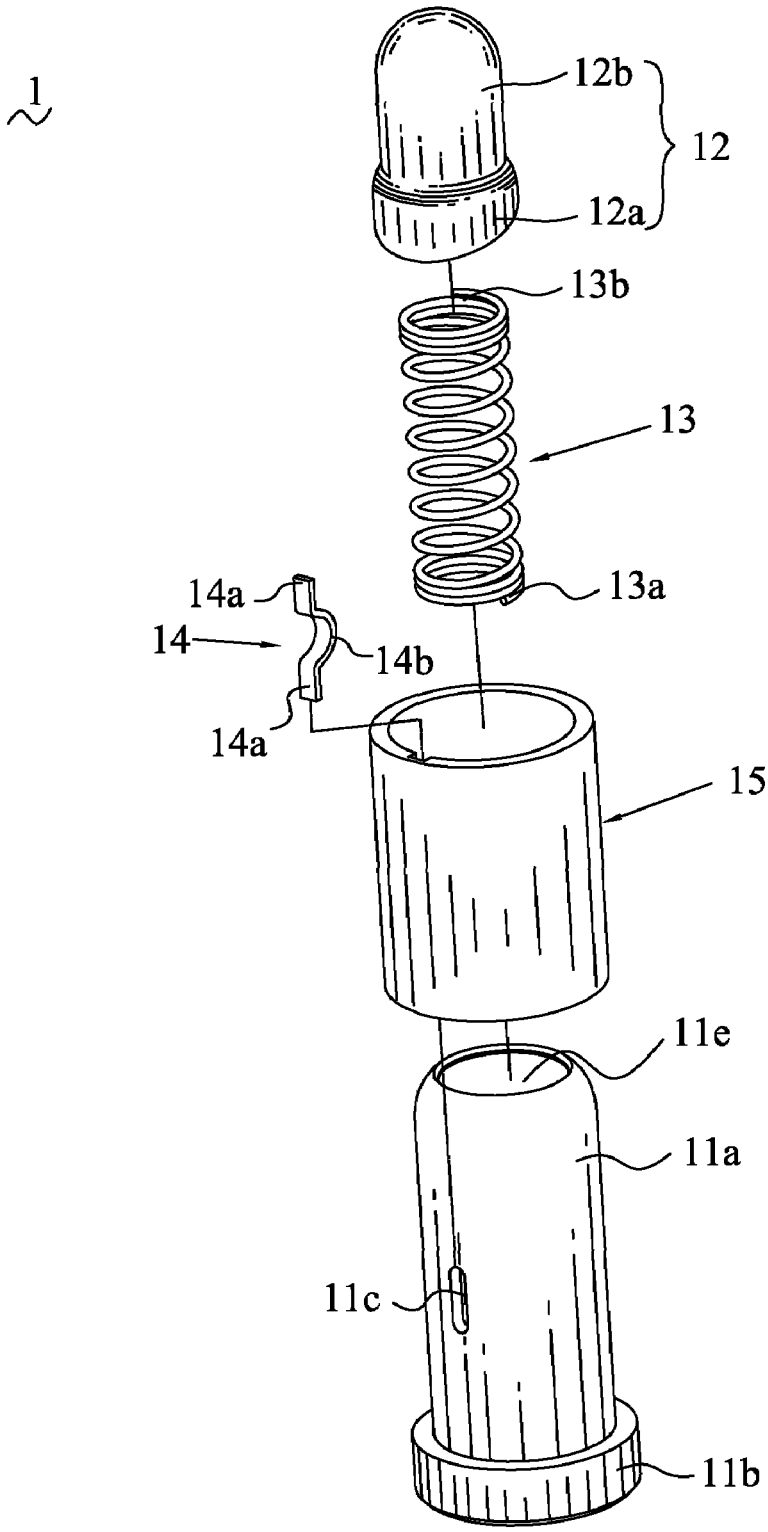
FIG. 2 is an exploded, perspective view of the probe connector shown in FIG. 1.
Figure 3:
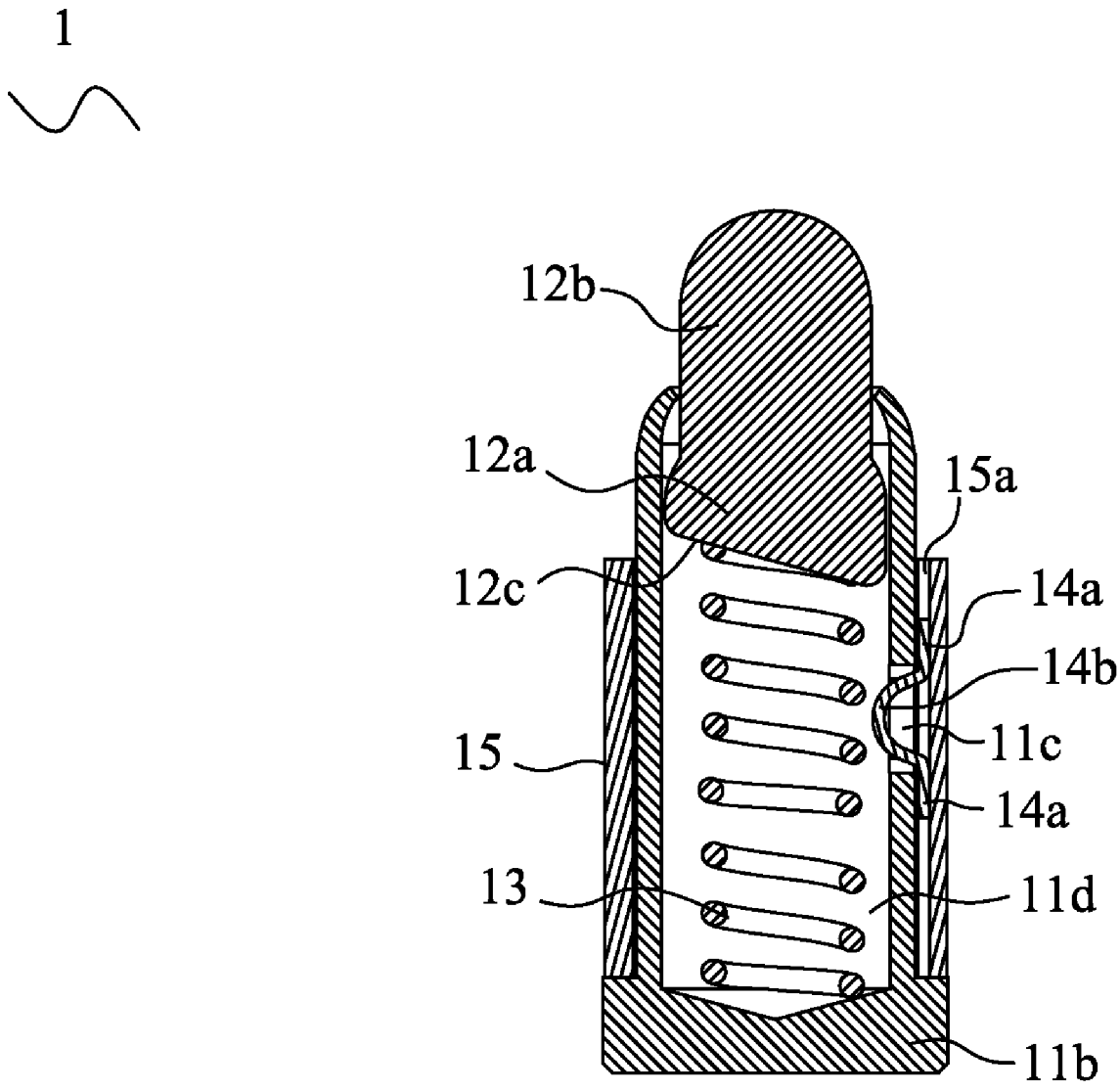
FIG. 3 is a cross-sectional view of the probe connector shown in FIG. 1.

With reference to FIGS. 1-3, the first embodiment in accordance with the present invention is embodied in a probe connector 1. The probe connector 1 includes a hollow barrel 11, a plunger 12, and an elastic element 13 received in the barrel 11. The barrel 11 and the plunger 12 are made of metallic material. The elastic element 13 defines a first end 13*a* and a second end 13*b* opposite to the first end 13*a*.

The barrel 11 has a cylindraceous main body 11*a* which defines a chamber 11*d* therein, and a base 11*b* integrally sealed one end of the main body 11*a* for being against the first end 13*a* of the elastic element 13. The main body 11*a* has an opening or a slot 11*c* at a substantial middle portion thereof and communicating with the chamber 11*d*. In this embodiment, the slot 11*c* extends along a longitudinal direction of the main body 11*a*. The other end of the main body 11*a* is bent inwards to form an opening 11*e* when the plunger 12 is mounted to the barrel 11, for fixing the plunger 12 and the barrel 11 together. The base 11*b* is a short-pillar shape and has an outer diameter larger than that of the main body 11*a*.

The plunger 12 of cylindrical shape includes a basic portion 12*a*, and a contact portion 12*b* extending outwards from one end of the basic portion 12*a*. The basic portion 12*a* defines a ramped bottom surface 12*c* opposite to the contact portion 12*b* and against the second end 13*b* of the elastic element 13. The diameter of the contact portion 12*b* is less than that of the basic portion 12*a*, with a free end shaped as a dome. The basic portion 12*a* is received in the chamber 11*d* of the barrel 11 and the contact portion 12*b* extends out of the barrel 11 through the opening 11*e*. The outer dimension of the basic portion 12*a* is less than the inner dimension of the main body 11*a* for allowing the basic portion 12*a* to be inclinably received in the chamber 11*d*. The dimension of the opening 11*e* is less than the outer dimension of the basic portion 12*a* for preventing the basic portion 12*a* from removing out of the chamber 11*d*.

The probe connector 1 further has a resting element 14 mounted to the main body 11*a*, and a wrapping element 15 surrounding the main body 11*a*. The resting element 14, which may be bent with a metal strip, has an arc-shaped resting portion 14*b* and two fixing slices 14*a* extended opposite to each other from two free ends of the resting portion 14*b*. The wrapping element 15 is a cylinder, with an inner diameter thereof substantially the same as an outer diameter of the main body 11*a*. An inner surface of the wrapping element 15 is formed with a receiving groove 15*a* extending longitudinally and reaching two opposite edges thereof. In this embodiment, the receiving groove 15*a* has a depth substantially the same as a thickness of the fixing slices 14*a*. In assembly, the resting portion 14*b* is inserted into the chamber 11*d* of the barrel 11 through the slot 11*c*. The fixing slices 14*a* are disposed to lean against an outer surface of the main body 11*a*. The wrapping element 15 slidably fits around the main body 11*a* and is supported by the base 11*b*, with the fixing slices 14*a* received in the receiving groove 15*a*. A circumferential outer surface of the wrapping element 15 is substantially the same as a circumferential outer surface of the base 11*b*. The fixing slices 14*a* are sandwiched between the main body 11*a* and the wrapping element 15 for fixing the resting element 14.

Figure 5:
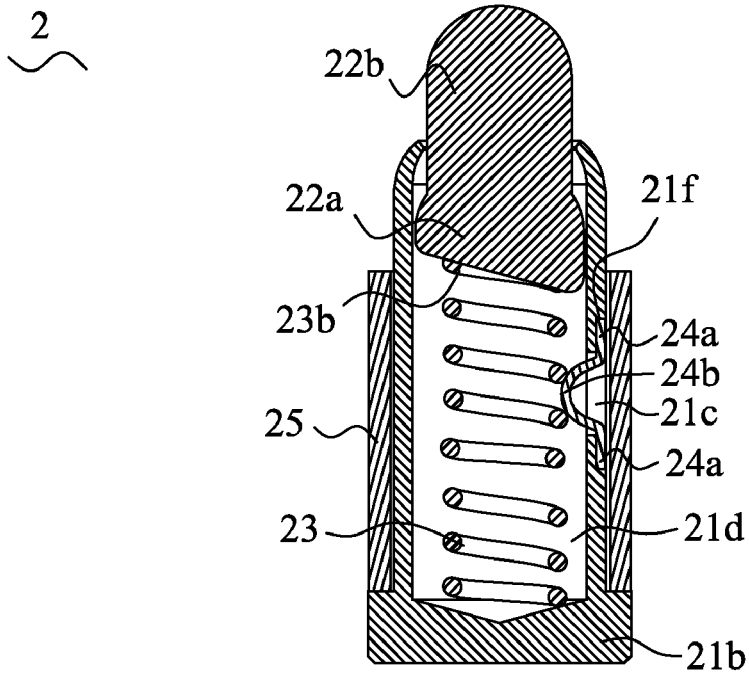
FIG. 5 is a cross-sectional view of a probe connector of a second embodiment in accordance with the present invention.

FIG. 5 is a cross-sectional view showing a probe connector 2 of the second embodiment. The probe connector 2 is analogue to the probe connector 1 in the first embodiment except for the receiving groove. In the second embodiment, there are two receiving grooves 21*f* which are formed at an outer periphery of the main body 21 and symmetrical about the slot 21*c*. The receiving grooves 21*f* communicate with the slot 21*c* for receiving the fixing slices 24*a* of the resting element 24 when the resting portion 24*b* is inserted into the slot 21*c*. In this embodiment, the depth of the receiving groove 21*f* is substantially the same as the thickness of the fixing slice 24*a*.

Figure 6:
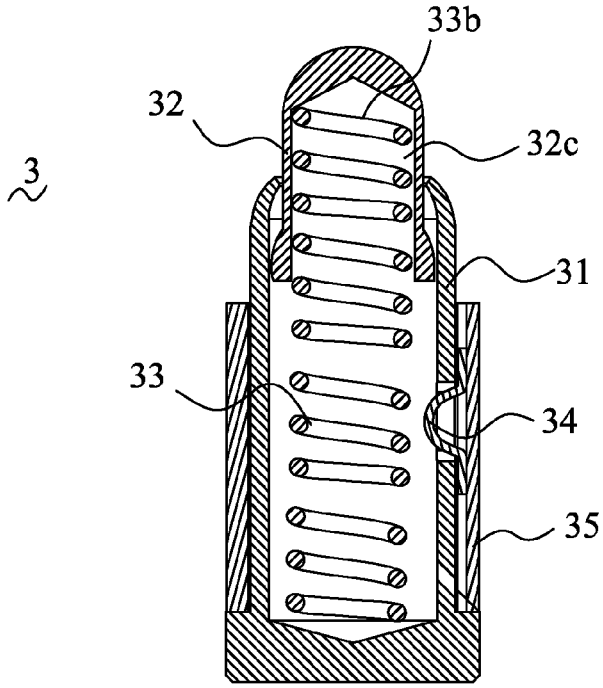
FIG. 6 is a cross-sectional view of a probe connector of a third embodiment in accordance with the present invention.
Figure 7:
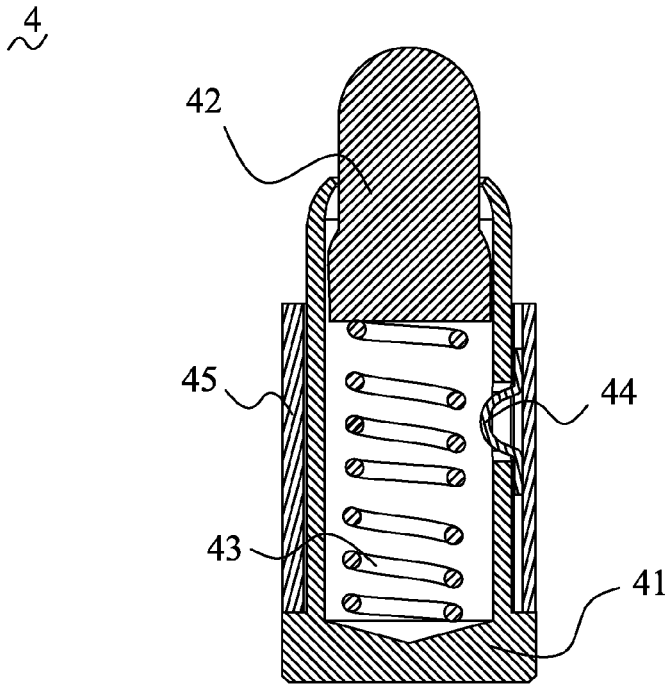
FIG. 7 is a cross-sectional view of a probe connector of a fourth embodiment in accordance with the present invention.

FIGS. 6-7 illustrate probe connectors 3 and 4 in the third and fourth embodiments, which are both substantially the same as the probe connector 1 in the first embedment except for the plungers. In the third embodiment, the basic portion 32*a* of the plunger 32 has a columned restraining hole 32*c* at a bottom thereof, for receiving the second end 33*b* of the elastic element 33. In the fourth embodiment, the plunger 42 is shaped with a level bottom surface against the elastic element 43. It should be noted that the construction of the probe connector can be modified for meeting the different demands and should not be limited.

Figure 4:
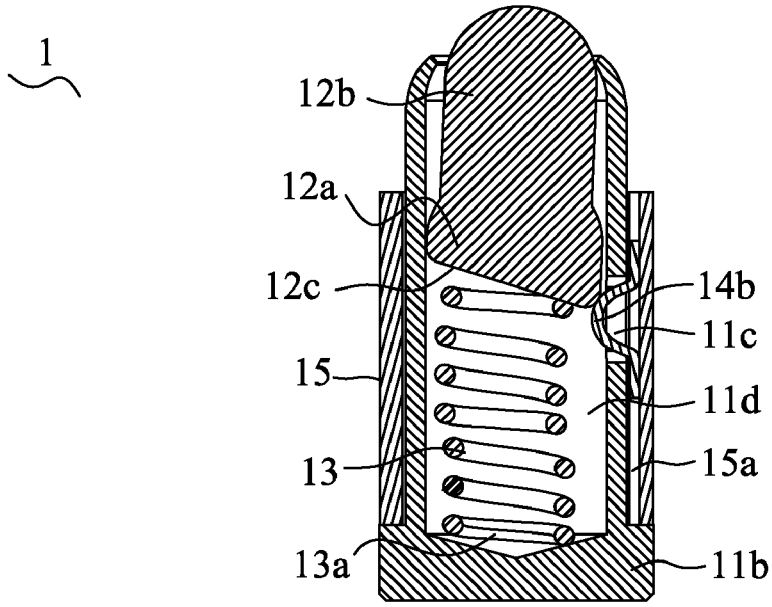
FIG. 4 is a cross-sectional view of the probe connector shown in FIG. 1, wherein a plunger is pressed inside a barrel.

Please refer to the FIG. 4, when the contact portion 12*b* of the plunger 12 is pressed downwards, the elastic element 13 is compressed downwards and distorted by the ramped bottom surface 12*c* of the basic portion 12*a* and generates an opposite force which acts on the ramped bottom surface 12*c* so that the basic portion 12*a* is deflected to contact an inner surface of the main body 11*a*. The resting portion 14*b* is extruded outwards by the basic portion 12*a* and generates an opposite force which acts on a side of the basic portion 12*a* opposite to a contact side of the basic portion 12*a* which contacts with the main body 11*a* by means of deflection of the basic portion 12*a*, reinforcing the contacting stability between the basic portion 12*a* and the main body 11*a*, without affecting by an unexpected shock or the like.

As described above, the fixing slices are sandwiched between the barrel and the wrapping element. The resting portion projects into the chamber through the slot. When the plunger is pressed downwards to make the basic portion extrude the resting portion outwards, in turn, the resting portion provides the opposite force pushing the basic portion to contact the inner surface of the main body steadily. It prevents the basic portion from breaking off the main body instantly when the probe connector suffers from the unexpected force.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A probe connector, comprising:

a barrel having a cylindraceous main body which defines a chamber therein, and a base connected with one end of the main body, the main body having an opening at a substantially middle portion thereof;

a plunger including a basic portion restricted in the barrel and a contact portion extended from one end of the basic portion and exposed from the other end of the main body;

a wrapping element surrounding an outer periphery of the main body; and a resting element having a resting portion of arc shape, and two fixing slices extended opposite to each other from two ends of the resting portion, the resting portion projecting into the chamber of the barrel through the opening, the fixing slices sandwiched between the barrel and the wrapping element, wherein the resting portion rests against a side of the basic portion when the contact portion is pressed downwards to deflect to contact an inner surface of the main body by an opposite side thereof.

2. The probe connector as claimed in claim 1, wherein the wrapping element has a receiving groove at an inner surface thereof, the fixing slices are received in the receiving groove.

3. The probe connector as claimed in claim 2, wherein the wrapping element is cylindraceous and slidably covered with the main body, the receiving groove passes through the wrapping element along a sliding direction of the wrapping element with respect to the main body, for slidably receiving the fixing slices which are disposed along the sliding direction.

4. The probe connector as claimed in claim 3, wherein the base has a circumferential outer surface exceeding a circumferential outer surface of the main body and substantially flush with a circumferential outer surface of the mounted wrapping element.

5. The probe connector as claimed in claim 1, wherein the main body has two receiving grooves at the outer periphery thereof and symmetrical about the opening, the fixing slices are received in the receiving grooves and restrained between the barrel and the wrapping element.

6. The probe connector as claimed in claim 1, further comprising an elastic element arranged inside the barrel, the basic portion being shaped with a ramped bottom surface against an end of the elastic element for making the basic portion deflect to touch the main body when the plunger is pressed downwards.

7. The probe connector as claimed in claim 1, further comprising an elastic element arranged inside the barrel, the basic portion has a restraining hole at a bottom thereof for receiving an end of the elastic element.

8. The probe connector as claimed in claim 1, further comprising an elastic element arranged inside the barrel, the basic portion is formed with a level surface against an end of the elastic element.

* * * * *